US007676874B2

(12) United States Patent
Cho

(10) Patent No.: US 7,676,874 B2
(45) Date of Patent: Mar. 16, 2010

(54) WASHING MACHINE WITH STILLNESS MODE AND METHOD OF OPERATING THE SAME

(75) Inventor: Han Ki Cho, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 243 days.

(21) Appl. No.: 11/765,031

(22) Filed: Jun. 19, 2007

(65) Prior Publication Data

US 2007/0294839 A1 Dec. 27, 2007

(30) Foreign Application Priority Data

Jun. 21, 2006 (KR) ..... 10-2006-0055889

(51) Int. Cl.
*D06F 35/00* (2006.01)
*D06F 33/00* (2006.01)
*D06F 29/00* (2006.01)

(52) U.S. Cl. ..... 8/158; 8/159; 68/12.27; 68/23.1

(58) Field of Classification Search ..... 68/23.1, 68/23.4, 12.27
See application file for complete search history.

(56) References Cited

U.S. PATENT DOCUMENTS 4,517,695 A * 5/1985 Hoffmann et al. ..... 8/158
6,065,170 A * 5/2000 Jang ..... 8/158
2002/0078511 A1 * 6/2002 Blair et al. ..... 8/159

FOREIGN PATENT DOCUMENTS

JP 02-077290 A 3/1990

OTHER PUBLICATIONS

Chinese Office Action dated Jun. 19, 2009.

* cited by examiner

*Primary Examiner*—Michael Barr
*Assistant Examiner*—Jason Y Ko
(74) *Attorney, Agent, or Firm*—Ked & Associates LLP

(57) ABSTRACT

Disclosed herein is a still operation of a washing machine, and more particularly, a washing machine which includes an operation condition of the washing machine in correspondence with each of a plurality of stillness modes and operates according to the operation condition corresponding to any one selected from the plurality of stillness modes. The washing machine includes a controller which, by the selection of any one of a plurality of stillness modes which are distinguished according to a stillness degree of an operation, controls the washing machine according to an operation condition corresponding to the selected stillness mode.

14 Claims, 5 Drawing Sheets

WASHING MACHINE WITH STILLNESS MODE AND METHOD OF OPERATING THE SAME

This application claims the benefit of Korean Patent Application No. 10-2006-0055889, filed on Jun. 21, 2006, which is hereby incorporated by reference as if fully set forth herein.

BACKGROUND OF THE INVENTION

1. Field of the Invention

The present invention relates to a still operation of a washing machine, and more particularly, to a washing machine which includes an operation condition of the washing machine in correspondence with each of a plurality of stillness modes and operates according to the operation condition corresponding to any one selected from the plurality of stillness modes.

2. Discussion of the Related Art

In general, when dirty clothes are put into washing water, the clothes are washed by a chemical action of a detergent. However, if only the detergent is used, a washing time is long and the clothes may be damaged. Accordingly, in a washing machine, a mechanical action such as proper friction or vibration is applied to the clothes immersed in the washing water, for the purpose of improving a washing speed.

A drier is a mechanical device for drying wet laundry by hot air.

A washing machine is a device for processing laundry, which includes a washer, a drier, and dehydrator.

Recently, a consumer's request for the improvement and diversification of the capability of the washing machine is gradually increasing. A consumer's request for a still operation of the washing machine is also gradually increasing.

Consumers want a quite life. In particular, since there are frequent occasions when a washing machine is driven at night, a still operation is required.

A consumer may want or may not want a still operation. If a consumer wants a short operation time of a washing machine due to lack of time, a still operation may not be required.

However, a conventional washing machine is designed such that there is no room for selecting a stillness degree of an operation. Although a consumer wants a higher stillness degree of an operation, the washing machine should operate in a stillness mode set previously.

A consumer does not need to necessarily select the stillness degree of the operation, but a washing machine requires a variety of stillness modes. The stillness mode may vary depending on a condition.

For example, a dehydration operation of a conventional washing machine will be described with reference to FIGS. 1 and 2.

First, FIG. 1 is a flowchart illustrating a dehydration operation method of a conventional washing machine and FIG. 2 is a graph showing rotation speed (RPM) versus time in the dehydration operation method of the conventional washing machine.

In general, the dehydration function of the washing machine includes steps of disentangling laundry, evenly distributing the laundry, and detecting an unbalance amount (hereinafter, referred to as a UB amount). A drum stops or accelerates to perform a main dehydration mode according to the result of detecting the UB amount.

Now, a method of detecting the UB amount will be described with reference to FIGS. 1 and 2.

First, when a mode is switched to a dehydration mode, the rotation speed of the drum (not shown) in which laundry is contained increases and this state is maintained (S1).

Next, a degree to which the laundry is unevenly distributed in the drum, that is, the UB amount, is detected (S2).

For example, the UB amount is detected using a variation in rotation speed of a motor. That is, while rotating the motor by a predetermined dehydration algorithm, a position detection hall sensor mounted in the motor detects the rotation speed of the motor in a predetermined time period to measure a variation in rotation speed of the motor, and the UB mount is detected using a difference between a maximum value and a minimum value of the measured values. Since the method of detecting the UB amount is widely known, the detailed description thereof will be omitted.

Next, it is determined whether the UB amount is greater than an allowable value of a system, that is, a reference UB amount (S3).

If it is determined that the UB amount is greater than the reference UB amount, the dehydration operation is stopped in order to prevent the system from being damaged due to excessive rotation (S4) In contrast, if it is determined that the UB amount is less than the reference UB amount, the rotation speed of the motor increases and the main dehydration operation is performed (S5).

In the main dehydration operation, the drum rotates up to a maximum rotation speed.

Noise and vibration occur in the above-described dehydration operation of the washing machine.

In particular, noise or vibration varies depending on the condition of a floor on which the washing machine is installed. For example, in a case where the washing machine is installed on a wooden floor, the noise or vibration of the washing machine increases compared with a case where the washing machine is installed on a concrete floor.

Although the washing machine is installed on the same floor, a degree to which the noise or vibration is felt by a consumer varies depending on a use time period. The noise or vibration is felt to be larger during a quiet night than during the day.

Such a problem is not restricted to the dehydration operation and may be generated in a washing operation or a drying operation.

A principal factor for the noise or vibration may be related to the rotation speed of the drum. When the rotation speed of the drum increases in the washing operation, the drying operation or the dehydration operation, the noise or vibration increases.

That is, since the conventional washing machine is designed such that there is no room for selecting a stillness degree of an operation, a user feels inconvenience.

SUMMARY OF THE INVENTION

Accordingly, the present invention is directed to a washing machine with a stillness mode and method of operating the same that substantially obviate one or more problems due to limitations and disadvantages of the related art.

An object of the present invention is to provide a washing machine which includes a plurality of stillness modes with relation to a still operation, and performs an operation by properly selecting any one of the plurality of stillness modes according to a use environment or the situation of a consumer.

Another object of the present invention is to provide a washing machine which is capable of performing a still operation desired by a consumer by changing an operation condition according to the condition of a floor on which the washing machine is installed.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a washing machine includes a controller which, by the selection of any one of a plurality of stillness modes which are distinguished according to a stillness degree of an operation, controls the washing machine according to an operation condition corresponding to the selected stillness mode.

Even under the same operation condition, the stillness degree may vary depending on an environment in which the washing machine is installed. For example, in a case where the washing machine is installed on a wooden floor, the stillness degree is lower compared with the case where the washing machine is installed on a concrete floor.

At this time, when the operation condition is changed by selecting a proper stillness mode, a still operation can be realized even when the washing machine is installed on the wooden floor.

When a higher stillness mode is required, a proper stillness mode is selected in the same installation environment and the washing machine is controlled to be operated in the operation condition corresponding to the selected stillness mode.

Accordingly, the plurality of stillness modes are preferably distinguished according to the installation environment of the washing machine. The installation environment preferably includes the condition of a floor on which the washing machine is installed.

A user may select a stillness mode corresponding to the floor condition so as to operate the washing machine in an operation condition suitable for the floor condition, thereby ensuring stillness. For example, a first stillness mode is selected in the concrete floor and a second stillness mode is selected in the wooden floor. The first stillness mode may be set to a default mode.

Preferably, the washing machine may further include a stillness mode selector for allowing the user to select any one of the plurality of stillness modes. The selector may be configured in the form of a button. The user presses a button corresponding to a desired stillness mode to select the stillness mode.

At least one of the plurality of stillness modes may be set as a default mode. For example, when the number of stillness modes is two, one stillness mode is automatically selected between them and a general operation of the washing machine is performed in the stillness mode selected automatically. When the other stillness mode is selected, the washing machine operates in the selected mode. The selector may include a selection button.

Preferably, the plurality of stillness modes may be distinguished according to a vibration degree. It is preferable that the still operation is related to vibration as well as noise.

In particular, if a house type is an apartment, a house located just below a house where a washing machine operates feels inconvenience due to the delivery of vibration via a floor, rather than due to noise which occurs in the washing machine. Accordingly, it is preferable that the plurality of stillness modes are distinguished according to the vibration degree.

The vibration for distinguishing among the stillness modes is preferably the vibration of the external appearance of the washing machine. For example, the vibration of the top of a cabinet configuring the external appearance of the washing machine may be used for distinguishing among the stillness modes. Alternatively, the vibration of the other component such as a drum or a tub may be used.

The operation condition may include a washing condition related to a washing operation or a drying condition related to a drying operation. However, the operation condition preferably includes a dehydration condition related to a dehydration operation. This is because the rotation speed of the drum is highest and the vibration is large upon the dehydration operation.

Preferably, the dehydration condition may include the maximum rotation speed of the drum. That is, the maximum rotation speed of the drum upon the dehydration operation preferably varies depending on the stillness mode. For example, in a mode which requires a higher stillness degree, the maximum rotation speed of the drum is set to be relatively low.

Preferably, the maximum rotation speed of the drum may vary depending on the amount of laundry. When the amount of laundry is large in the same stillness mode, the maximum rotation speed of the drum is maintained to be low. This is because the vibration increases as the amount of laundry increases.

The dehydration condition may include a reference unbalance (UB) amount. That is, the reference UB amount may vary depending on the stillness mode.

For example, in a mode which requires a higher stillness degree, the reference UB amount may be set to be small. When the small reference UB amount is used, a main dehydration operation is performed only when an unbalance degree is low. Accordingly, the vibration is reduced in the main dehydration operation.

In another aspect of the present invention, a method of operating a washing machine includes a stillness mode selecting step of selecting any one of a plurality of stillness modes which are distinguished according to a stillness degree of an operation; and a stillness mode operating step of controlling and operating the washing machine according to an operation condition corresponding to the selected stillness mode.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 3:
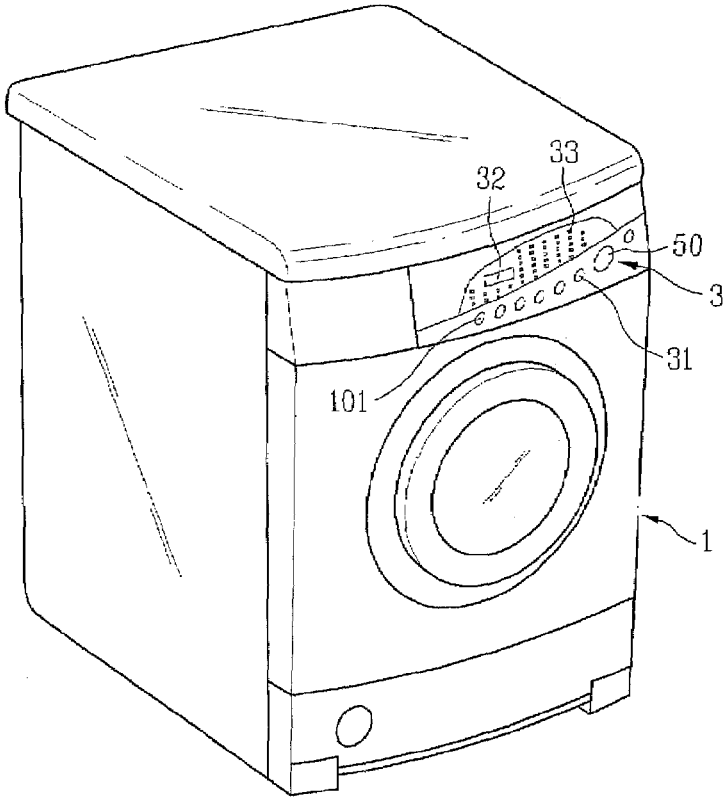
FIG. 3 is a view showing a washing machine according to the present invention.

FIG. 3 is a view showing an exemplary embodiment of a washing machine according to the present invention.

As shown, a control panel 3 having a display unit for displaying a residual time and input keys for allowing a user to selectively input a command signal related to an operation of the washing machine is provided at the front upper side of a washing machine 1.

The control panel 3 includes a plurality of buttons 31, a display window 32, a light-emitting diode (LED) window 33, and a rotary knob 50. The buttons and the rotary knob 50 are input units for operating the washing machine. That is, when a washing time, a washing method, a dehydration method and a drying method are selected, the buttons and the rotary knob 50 are manipulated to input a washing course and time desired by the user.

A controller (not shown) controls the washing machine according to the above-described input condition to perform the washing operation, the drying operation or the dehydration operation.

The LED window 33 and the display window 32 notify the user of a variety of washing information, such as a washing state or a residual time, via ON/OFF and characters and symbols.

The washing machine includes two stillness modes. The operation condition varies depending on the stillness mode.

The control panel 3 includes a selection button 101 for selecting a second stillness mode between the two stillness modes. When the user selects the selection button 101, the second selection mode is selected, and the controller controls the washing machine under the operation condition corresponding to the second selection mode.

A first stillness mode is set in a default mode. Accordingly, if the selection button 101 is not selected, the first stillness mode is automatically selected, and the controller controls the washing machine under the operation condition corresponding to the first stillness mode.

Figure 1:
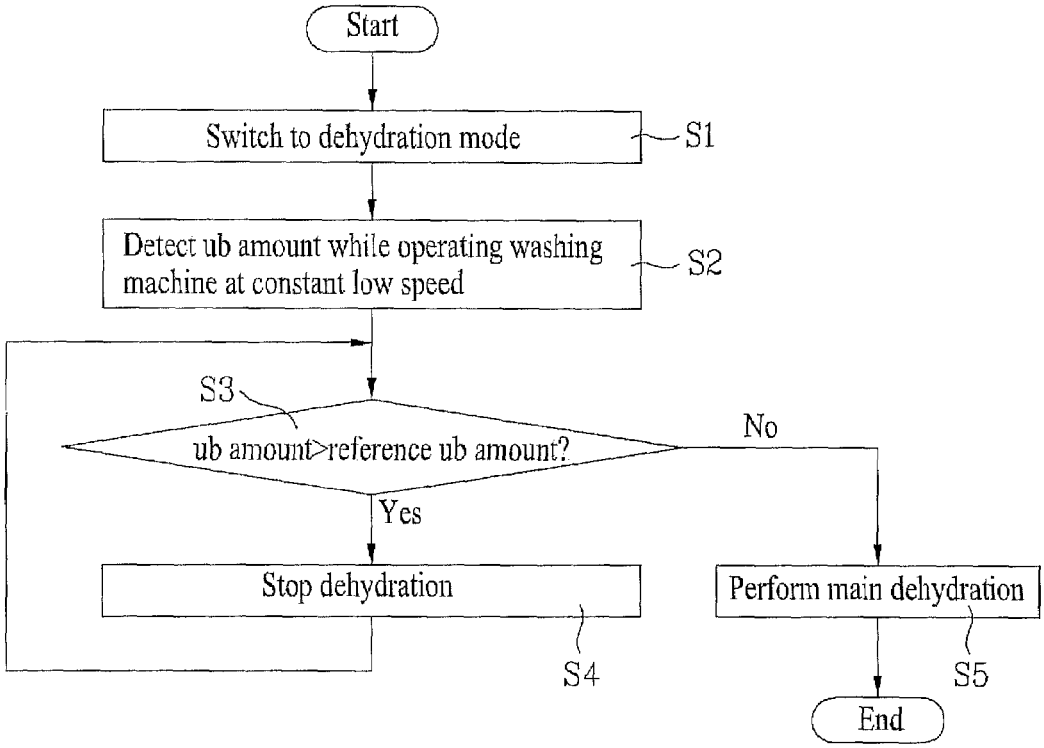
FIG.1 (Related Art)
FIGS. 1 and 2 are views explaining a conventional washing machine.
Figure 2:
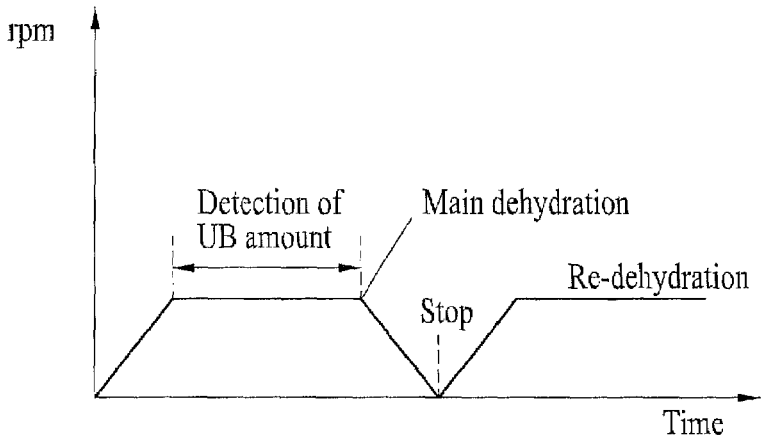
FIG.2 (Related Art)
Figure 4:
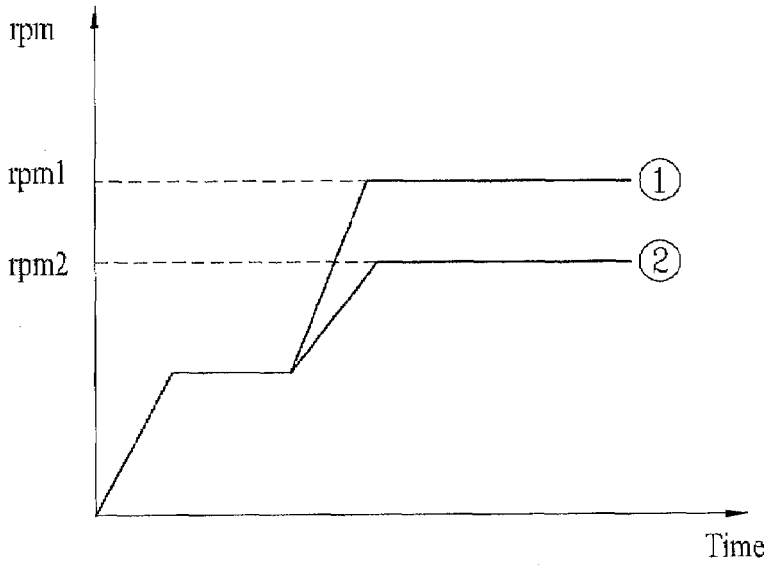
FIG. 4 is an embodiment of a dehydration condition according to a stillness mode.

FIG. 4 shows a dehydration condition among operation conditions, similar to FIG. 2. In FIG. 4, a vertical axis shows the rotation speed of the drum in the dehydration operation and a horizontal axis shows a time. In FIG. 4, a line ① indicates the first stillness mode and a line ② indicates the second stillness mode.

As shown, the maximum rotation speeds of the first stillness mode and the second stillness mode are different from each other in a main dehydration process.

When the second stillness mode is selected by selecting the selection button 101 on the control panel 3, the dehydration operation is performed according to the line ② in the graph shown in FIG. 4. When the selection button 101 is not selected, the dehydration operation is automatically performed according to the line ①.

Since the maximum rotation speed of the drum in the second stillness mode is smaller than that in the first stillness mode, the second stillness mode has a stillness degree higher than that of the first stillness mode.

Although not shown, a line ③ may be added to the graph shown in FIG. 4. Depending on the amount of laundry, the dehydration operation may be performed according to any one of the line ② and the line ③. The maximum rotation speed of the drum of the line ③ is different from that of the line ②.

For example, if the amount of laundry is small, the dehydration operation is performed according to the line ② and, if the amount of laundry is large, the dehydration operation is performed according to the line ③ which has the maximum rotation speed lower than that of the line ②.

Figure 5:
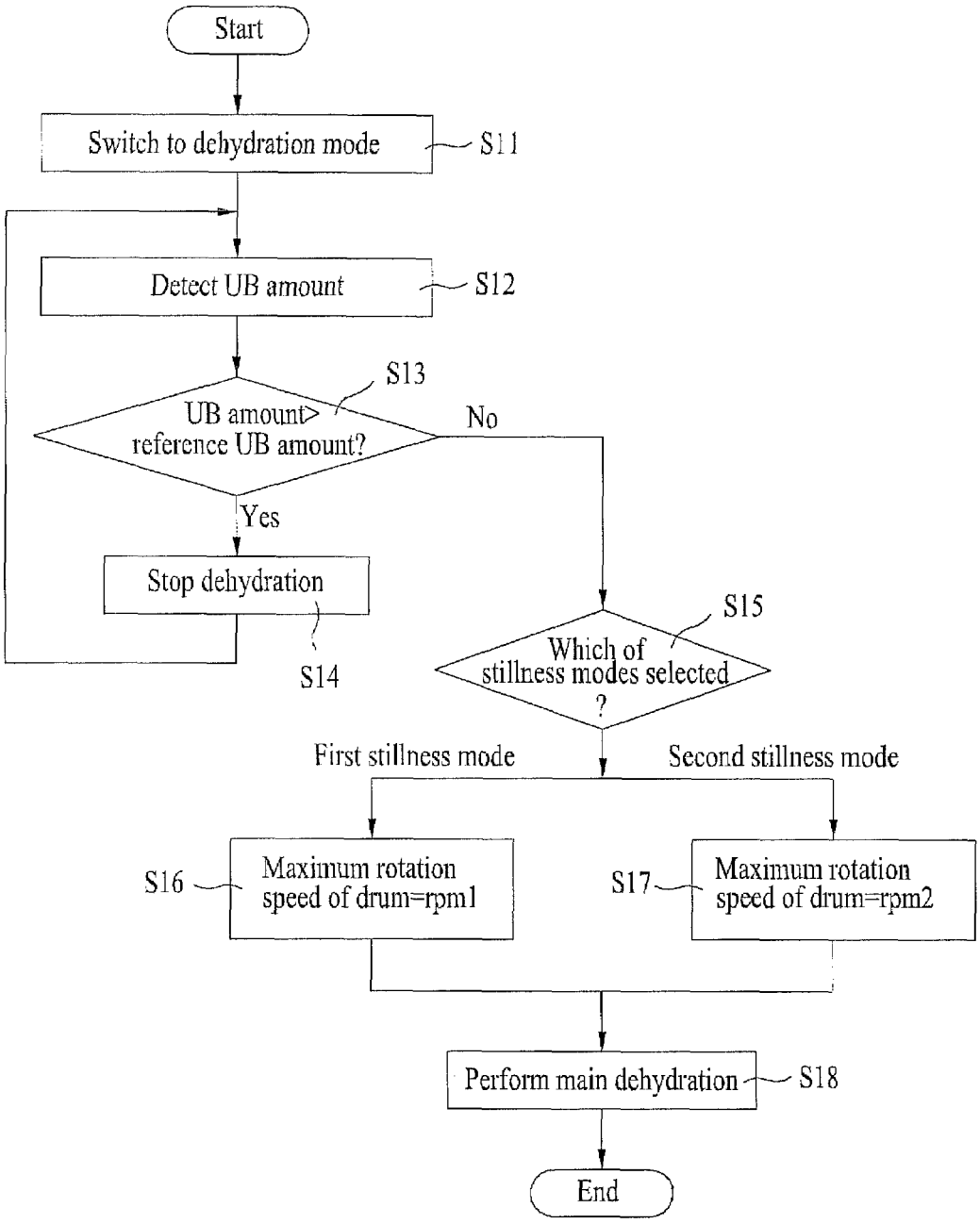
FIGS. 5 to 7 are flowcharts illustrating embodiments of a method of operating a washing machine according to the present invention.

FIG. 5 shows a flowchart illustrating the above-described operation.

When a washing mode is completed and is switched to a dehydration mode (S11), the UB amount is detected (S12) and the detected UB amount is compared with the reference UB amount set previously (S13).

If the detected UB amount is larger than the reference UB amount, the dehydration operation is stopped (S14) and the step S12 of detecting the UB amount is performed again.

If the detected UB amount is equal to or smaller than the reference UB amount, a main dehydration operation is performed.

At this time, it is checked which of the stillness modes is selected (S15) and the maximum rotation speed of the drum is determined according to the selected stillness mode (S16 and S17).

The rotation speed of the drum increases up to the maximum rotation speed and the main dehydration operation is performed (S18).

Figure 6:
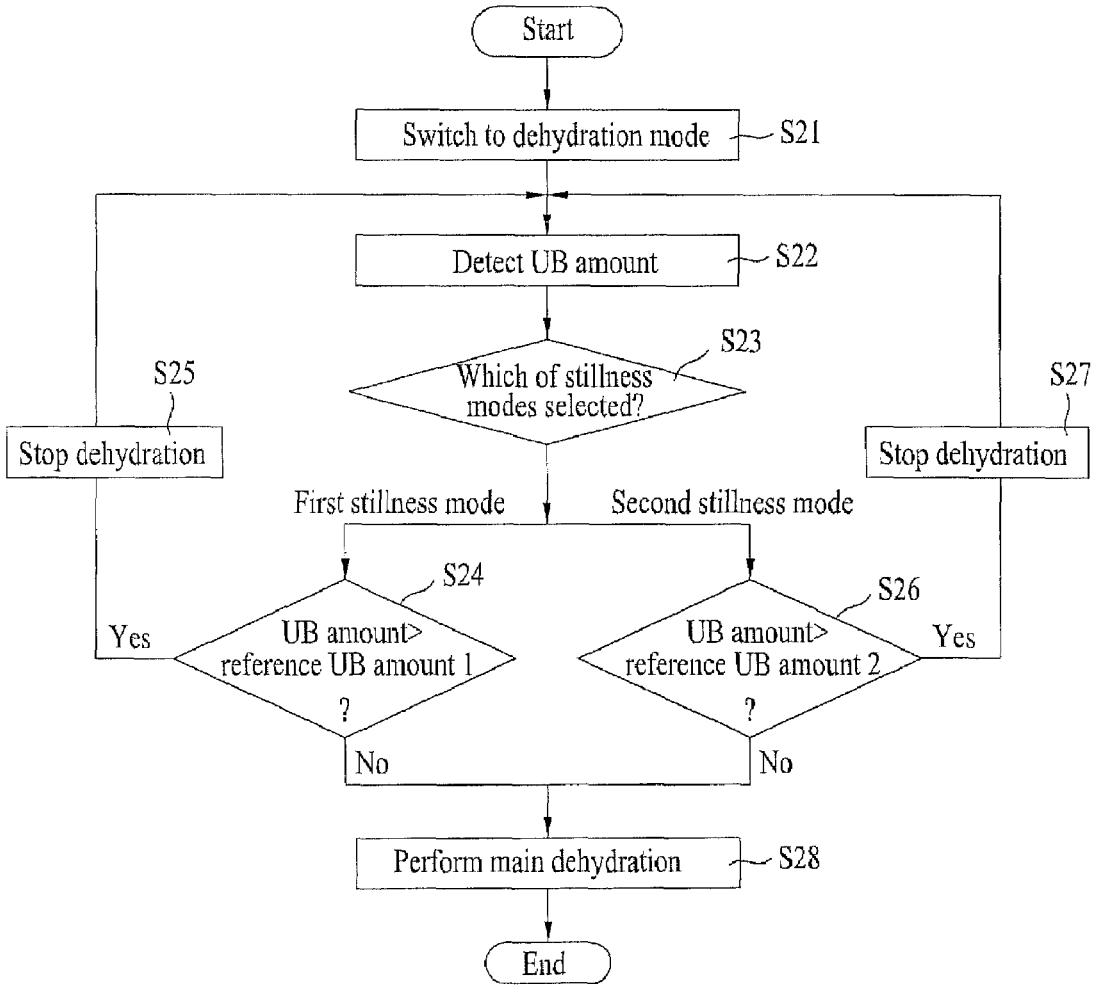

FIG. 6 shows another embodiment of the present invention. In the present embodiment, a dehydration operation is performed using a reference UB amount which varies depending on a stillness mode.

First, when the mode is switched to the dehydration mode (S21), the UB amount is detected (S22).

It is checked which of the stillness modes is selected (S23). If the first stillness mode is selected, a reference UB amount 1 is used (S24) and, if the second stillness mode is selected, a reference UB amount 2 is used (S26).

After the detected UB amount is compared with the reference UB amount (S24 and S26), the dehydration operation is stopped (S25 and S27) or the main dehydration operation is performed (S28), similar to the above-described embodiment.

The reference UB amount 2 is set to be less than the first reference UB amount 1. Accordingly, when the main dehydration operation starts, an unbalance degree of the second stillness mode is lower than that of the first stillness mode.

Since the unbalance degree is small in the second stillness mode, the second stillness mode has a stillness degree higher than that of the first stillness mode.

Figure 7:
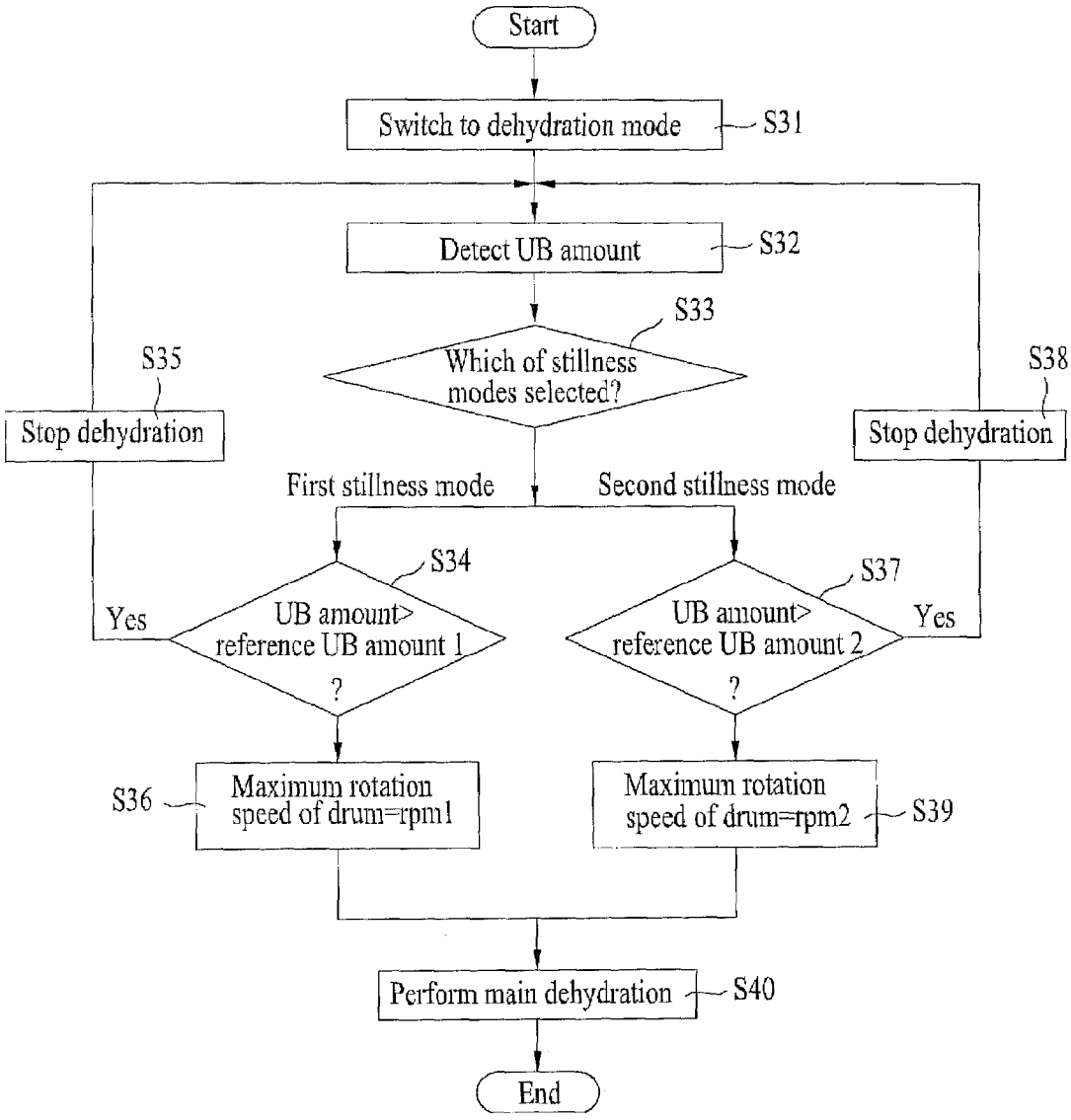

FIG. 7 shows another embodiment which is a combination of the above-described embodiments.

First, when the mode is switched to the dehydration operation (S31), the UB amount is detected (S32).

It is checked which of the stillness modes is selected (S33). If the first stillness mode is selected, the reference UB amount 1 is used (S34) and the maximum rotation speed of the drum in the main dehydration operation is determined to be rpm1 (S36).

If the second stillness mode is selected, the reference UB amount 2 is used (S37) and the maximum rotation speed of the drum in the main dehydration operation is determined to be rpm2 (S39).

After the detected UB amount is compared with the reference UB amount (S34 and S37), the dehydration operation is stopped (S35 and S37) or the main dehydration operation is performed (S40), similar to the above-described embodiment.

According to the present invention, it is possible to obtain a washing machine which operates in a stillness mode having a stillness degree higher than that of the conventional washing machine.

A user can select a desired stillness mode according to a use environment or situation. Since the washing machine can operate according to the desired stillness mode, it is possible to meet a variety of demands of consumers.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A washing machine, comprising:

a cabinet configuring an external appearance of the washing machine;

a drum rotatably mounted inside of the cabinet; and a controller that, by selection of one of a plurality of stillness modes which is distinguished according to a stillness degree of an operation, controls an operation of the drum according to an operation condition corresponding to the selected stillness mode, wherein the plurality of stillness modes is distinguished according to an installation environment of the washing machine, wherein the installation environment includes a condition of a floor on which the washing machine is installed.

2. The washing machine according to claim 1, further comprising a stillness mode selector that allows a user to select one of the plurality of stillness modes.

3. The washing machine according to claim 2, wherein at least one of the plurality of stillness modes is set as a default stillness mode.

4. The washing machine according to claim 1, wherein the plurality of stillness modes is distinguished according to a vibration degree.

5. The washing machine according to claim 4, wherein the operation condition is a dehydration condition.

6. The washing machine according to claim 5, wherein the dehydration condition includes a maximum rotation speed of the drum.

7. The washing machine according to claim 6, wherein the maximum rotation speed of the drum varies depending on an amount of laundry.

8. The washing machine according to claim 5, wherein the dehydration condition includes a reference unbalance (UB) amount.

9. A method of operating a washing machine, the method comprising:

providing for selection of one of a plurality of stillness modes which is distinguished according to a stillness degree of an operation; and controlling and operating the washing machine according to an operation condition corresponding to the selected stillness mode, wherein the plurality of stillness modes is distinguished according to an installation environment of the washing machine, wherein the installation environment includes a condition of a floor on which the washing machine is installed.

10. The method according to claim 9, wherein the plurality of stillness modes is distinguished according to a vibration degree.

11. The method according to claim 10, wherein the operation condition is a dehydration condition.

12. The method according to claim 11, wherein the dehydration condition includes a maximum rotation speed of a drum.

13. The method according to claim 12, wherein the maximum rotation speed of the drum varies depending on an amount of laundry.

14. The method according to claim 11, wherein the dehydration condition includes a reference unbalance (UB) amount.

* * * * *